US007811493B2

(12) United States Patent
Fanucci et al.

(10) Patent No.: US 7,811,493 B2
(45) Date of Patent: Oct. 12, 2010

(54) JOINER PANEL SYSTEM

(75) Inventors: Jerome P. Fanucci, Lexington, MA (US); Michael McAleenan, Georgetown, ME (US); Andrew F. Paddock, Billerica, MA (US); Bradley L. Paquin, Dracut, MA (US); Richard Balonis, Harbour Island, SC (US)

(73) Assignee: Kazak Composites, Incorporated, Woburn, MA (US)

( * ) Notice: Subject to any disclaimer, the term of this patent is extended or adjusted under 35 U.S.C. 154(b) by 961 days.

(21) Appl. No.: 10/947,977

(22) Filed: Sep. 23, 2004

(65) Prior Publication Data

US 2005/0072087 A1 Apr. 7, 2005

Related U.S. Application Data

(60) Provisional application No. 60/505,237, filed on Sep. 23, 2003.

(51) Int. Cl.
*B29C 47/06* (2006.01)

(52) U.S. Cl. ..... 264/171.1; 264/176.1; 264/211.12; 264/211.14

(58) Field of Classification Search ..... None
See application file for complete search history.

(56) References Cited

U.S. PATENT DOCUMENTS 4,250,136 A * 2/1981 Rex ..... 264/257
5,665,295 A * 9/1997 Takamoto et al. ..... 264/172.19
5,807,514 A * 9/1998 Grinshpun et al. ..... 264/45.8
6,864,297 B2 3/2005 Nutt et al.

FOREIGN PATENT DOCUMENTS

WO WO 2004/009681 1/2004

OTHER PUBLICATIONS

Borden Chemical, Inc., Durite® Phenolic Resin.
Georgia-Pacific Resins, Inc., "Phenolic Resins for Composites Product Information".
Shea Technology, "Fireban® Mark VIItm Part A Resin Binder for Fiberglass Laminating".

(Continued)

*Primary Examiner*—Monica A Huson
(74) *Attorney, Agent, or Firm*—Weingarten, Schurgin, Gagnebin & Lebovici LLP

(57) ABSTRACT

A joiner panel system is formed from a composite material and includes a panel attached to a deck by a coaming or shoe and attached at its upper edge by a curtain plate that fits around obstructions at the ceiling area. The shoe can be readily installed to an uneven steel deck by stud welding to reduce installation time or attached to a composite material deck. A curtain plate fabrication method uses a laser scan or close range photogrammetry of the overhead area to optimize and automate the cutting of curtain plate sections. The curtain plate sections can then be readily installed in the overhead area. A composite material panel to provide good flame, smoke and toxicity properties and good mechanical properties is formed from a phenolic resin foam material, microballoons to reduce the weight and density, and reinforcing fibers and powder material to improve the mechanical properties. The panel can be formed by a method in which the core and face skins are co-cured to provide a good bond.

5 Claims, 10 Drawing Sheets

OTHER PUBLICATIONS

Vaikhankski, L.; Synthesis of composite foam from thermoplastic microspheres and 3D long fibers; Composites: Part A 34 (2003) 755-763.

Vaikhankski, L.; Fiber-reinforced composite foam from expandable PVC microspheres; Composites: Part A 34 (2003) 1245-1253.

* cited by examiner

JOINER PANEL SYSTEM

CROSS REFERENCE TO RELATED APPLICATIONS

This application claims priority under 35 U.S.C. § 119(e) of U.S. Provisional Application No. 60/505,237, filed on Sep. 23, 2003, the disclosure of which is incorporated by reference herein.

STATEMENT REGARDING FEDERALLY SPONSORED RESEARCH OR DEVELOPMENT

The work leading to the invention received support from the United States federal government under SBIR Grant, Contract Nos. N00024-02-C-4112 and N00024-03-C-4152. The federal government may have certain rights in this invention.

BACKGROUND OF THE INVENTION

Joiner panels are nonstructural partitions used to subdivide areas within a structure such as a building or ship. For example, joiner panels subdivide the area between major structural bulkheads of a ship into smaller public and private cabins, passageways and other spaces. While not part of the ship's primary structure, joiner panels are required to provide some level of structural performance, because items are frequently mounted to their faces. Therefore, the joiner panels must not only be able to statically support the weight of attached hardware, but also must be able to withstand shock loads associated with the attached equipment. Other important characteristics of joiner panels include corrosion resistance, puncture and impact damage resistance associated with routine encounters with people and their equipment, ability to repair or replace damaged sections, rodent proofing, and acceptable flame, smoke and toxicity performance. Weight and installed cost of the joiner panel system are also important parameters.

A conventional joiner panel system has three primary hardware components: a flat panel, a shoe or coaming at the bottom of the panel, and a curtain plate at the top of the panel. The panels are usually fabricated as either sandwich panels, made with two thin fiberglass, aluminum or steel face sheets surfacing a core of foam or honeycomb, or integrally-stiffened panels, usually welded from aluminum or steel.

The shoe or coaming is used to connect the bottom of the panel to the support surface, such as the deck of a ship. The shoe is typically made of two elongated pieces of steel. The upper edge of the larger piece is bent into a Z-section with its upper edge some distance, for example, at least 6 inches, above the support surface. A smaller piece is welded to the side of the Z-section, forming a U-shaped channel along the upper edge of the shoe. The lower end of the joiner panel sits in the U-shaped channel of the shoe. Commonly, the joiner panel is attached to the shoe with occasional fasteners through both sides of the U-shaped channel and the panel. The lower edge of the larger piece of the shoe is sculpted to fit the contours of the supporting surface, such as an out-of-flat deck, and either welded continuously along the length of the shoe or spot welded.

The curtain plate provides the overhead connection for the upper edge of the joiner panel. A downwardly-opening U-shaped channel is formed along the lower edge of the curtain plate. In applications subject to movements, such as on a ship, the upper edge of the joiner panel can slide vertically in the U-shaped channel.

In many situations, the curtain plates must fit closely around numerous pipes, ducts, cable trays, and other hardware that occupies the overhead space. This fitting is currently done by cutting, fitting, and welding individually crafted steel sheets around the hardware to meet the specific closeout requirements, such as light, water, and pressure tightness. This task is labor intensive and costly.

SUMMARY OF THE INVENTION

The present invention relates to a joiner panel system formed from a composite material to provide a system that is lighter in weight than prior art metal systems, while still meeting the structural and mechanical requirements for which prior art metal systems are designed.

The system provides a coaming or shoe that is fabricated from a composite material and that can be readily installed to an uneven deck or other support surface. In one embodiment, a shoe can be stud welded to a steel deck to reduce installation time. In another embodiment, a shoe can be attached to a composite material deck.

The present invention also relates to a curtain plate fabrication method which uses a laser scan or close range photogrammetry of the overhead area to optimize and automate the cutting of curtain plate sections. The curtain plate sections can then be readily installed in the overhead area.

The present invention also relates to a composite material panel to provide good flame, smoke and toxicity (FST) properties and good mechanical properties. A phenolic resin foam material is used as the matrix material. This material provides improved flame, smoke and toxicity properties. Micro-balloons are provided to reduce the weight and density of the panel. Reinforcing fibers are provided to improve the mechanical properties. Powder materials can be added as well to further enhance mechanical properties and improve fire retardant properties.

DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
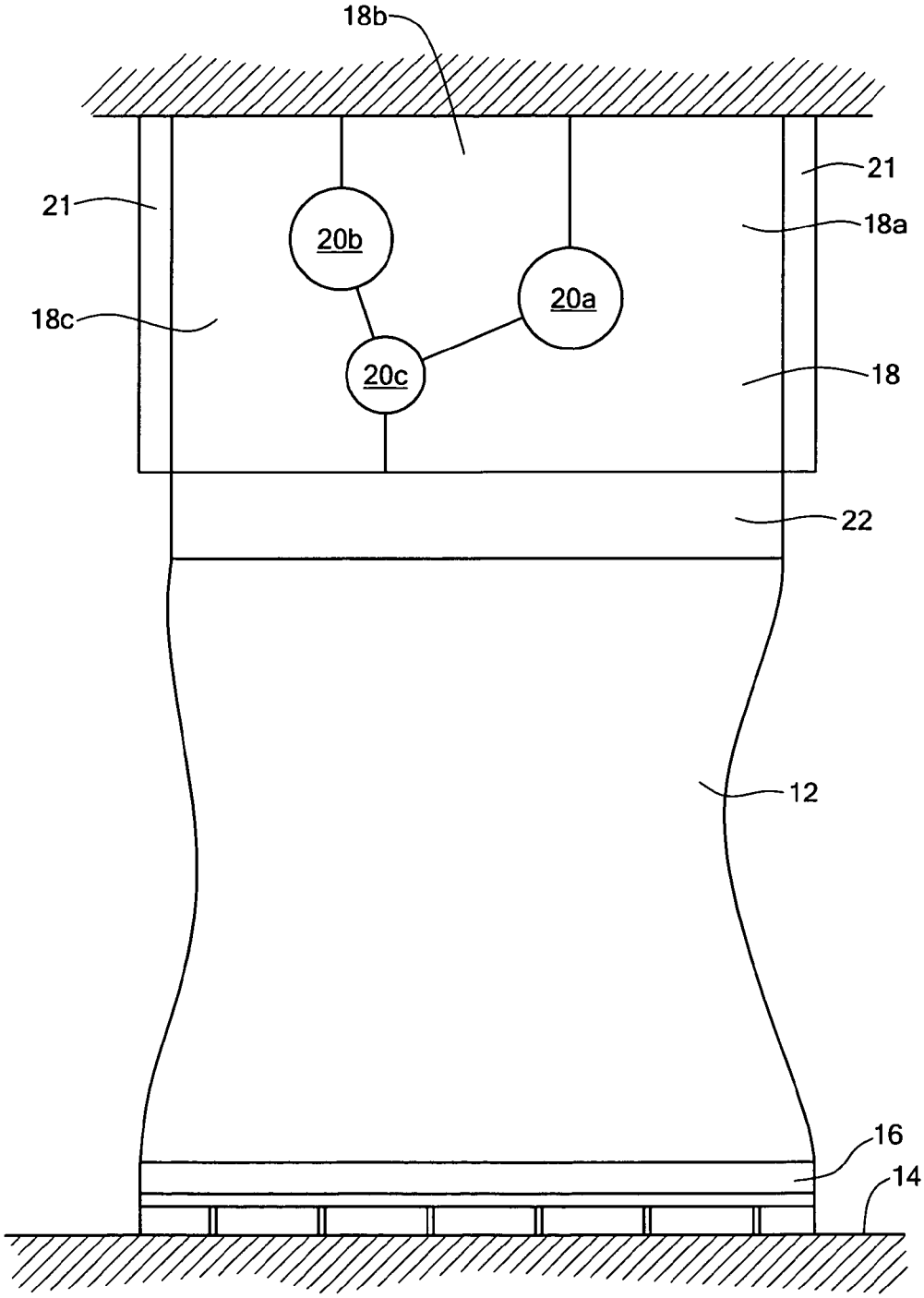
FIG. 1 is a schematic front view of a joiner panel system according to the present invention.

FIG. 1 illustrates a joiner panel system of the present invention. The system includes a joiner panel 12 attached at its lower edge to a deck 14 by a coaming or shoe 16 and attached at its upper edge to a curtain plate 18. The curtain plate is formed from a number of curtain plate sections 18*a*, 18*b*, 18*c* that have been cut to fit around overhead obstructions, such as pipes 20*a*, 20*b*, 20*c*. A joint section 22 is provided to join the upper edge of the joiner panel to the curtain plate.

Figure 3:
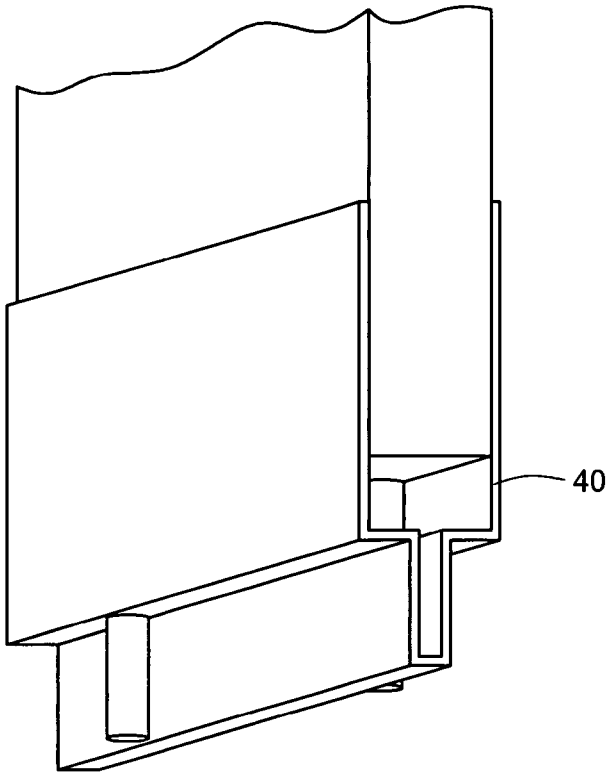
FIG. 3 is a schematic illustration of a further embodiment of a shoe of the present invention.
Figure 2:
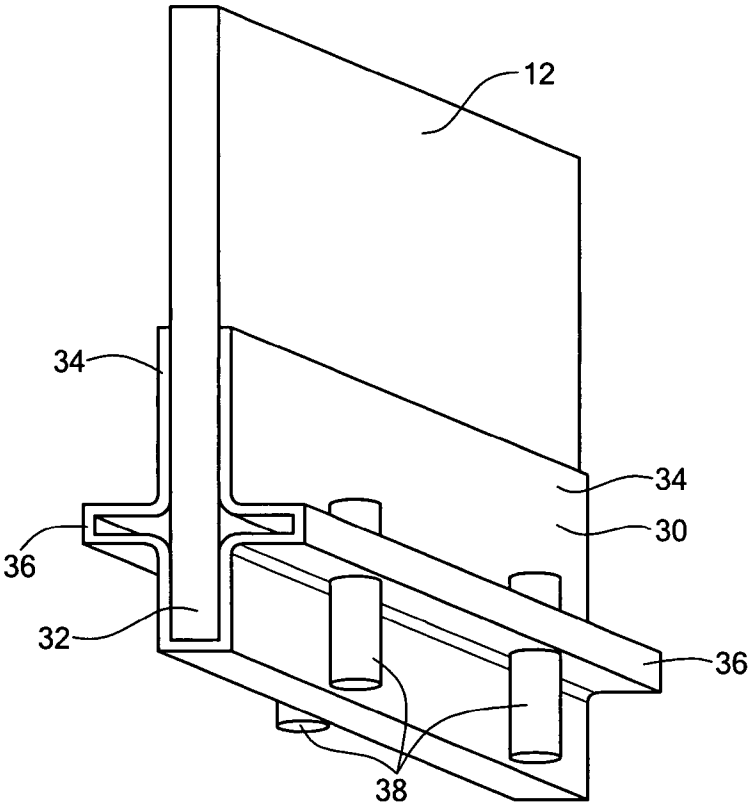
FIG. 2 is a schematic illustration of a shoe of the joiner panel system of the present invention suitable for attachment to a metal support surface.
Figure 5:
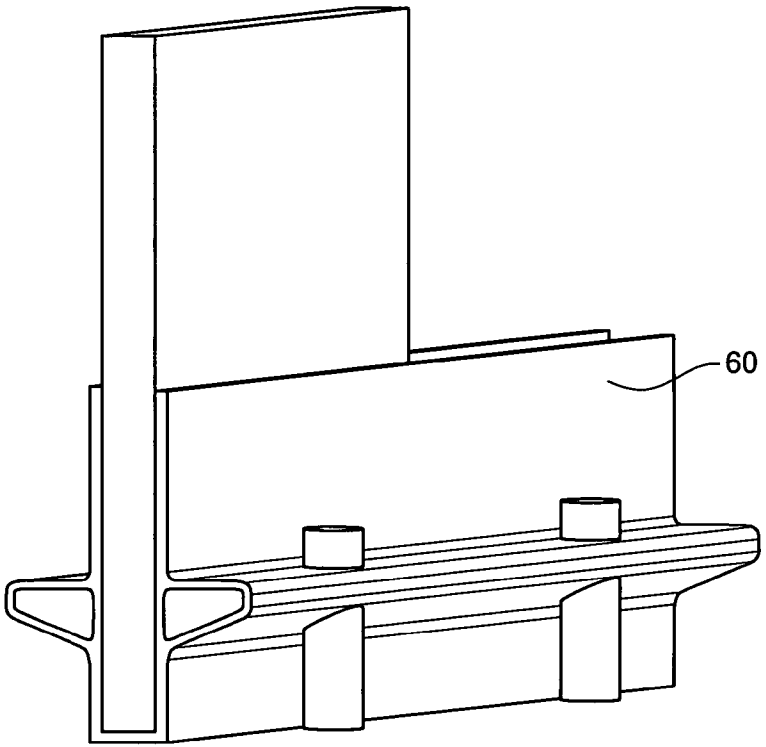
FIG. 5 is a schematic illustration of a further embodiment of a shoe of the present invention.
Figure 4:
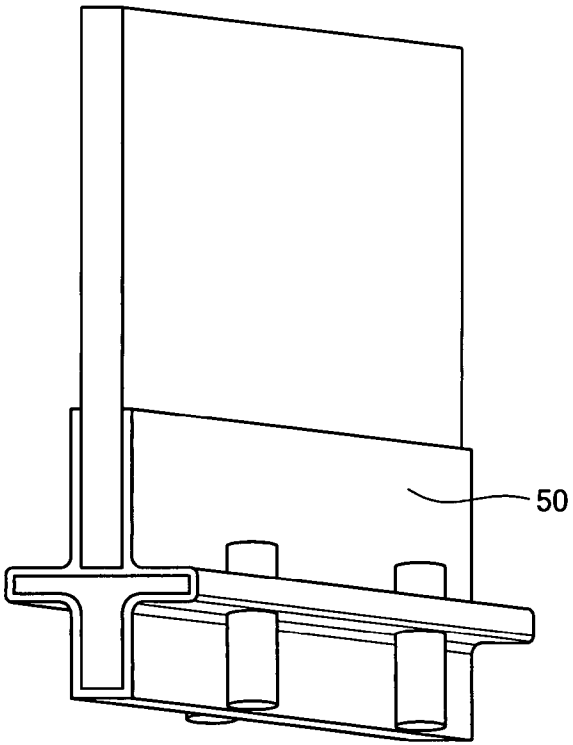
FIG. 4 is a schematic illustration of a further embodiment of a shoe of the present invention.

FIG. 2 illustrates one embodiment of a coaming or shoe 30 of the present invention suitable for attachment to a steel deck or support surface. The shoe includes a recess or seat 32 for the panel 12 between two parallel webs 34. Flanges 36 extend outwardly from each web on opposite sides. The seat or channel for the panel is symmetrically located with respect to the mounting flange or flanges to minimize torques caused by out-of-plane forces from the panel plus any attached hardware. Holes are drilled at regularly spaced intervals along the mounting flanges for attachment to the support surface. Studs 38 for attachment to the deck or other support surface are provided through the holes on opposite sides of the shoe. The studs may be offset (as shown) or transversely aligned. The studs prevent transverse movement of the shoe with respect to the deck. The studs are attached to the flanges of the shoe in any suitable manner, such as with nuts and washers, to prevent vertical movement of the shoe. In this embodiment, the flanges 36 are spaced above the deck, which allows visual inspection of the stud welds at the deck and the shoe/deck interface, while minimizing the area between the joiner panel and the deck. FIGS. 3-5 illustrate further embodiments of a shoe 40, 50, 60 of the present invention.

In one suitable method of fabrication, the coaming or shoe is produced by a pultrusion process, which is capable of producing the coaming as a single elongated member. After the coaming exits the pultrusion die, while still in motion on the pultrusion machine, holes are drilled at regularly spaced intervals. The holes in the pultruded coaming are transferred via a template to the deck or other support surface. Threaded connectors are prepositioned in a stud welding process on the deck in a pattern matching the automatically drilled holes in the pultruded coaming. A layer of epoxy putty of a type suitable for leveling and sealing purposes, as is known in ship building, is applied along the stud weld line and/or the bottom of the coaming. The coaming is then placed over the studs and bolted for a semi-permanent attachment to the support surface, providing a strong base for the remaining parts of the joiner panel system. A panel 12 is inserted into the seat of the coaming. An adhesive, such as of methylacrylate, can be applied in the channel before the panel is inserted into the channel if desired. Alternatively or additionally, the panel can be mechanically fastened, such as with rivets or bolts, to the coaming.

Other fastening systems to attach the coaming to the support surface can be used, such as adhesive or removable fasteners. Removable fasteners may include, for example, hook and loop type fasteners. A combination of fastening systems can be used.

In an alternative embodiment, the shoe can be produced integrally with the panel or attached to the panel during production. In this case, the panel/shoe combination is pressed into the bedding compound and bolted in place.

Figure 6:
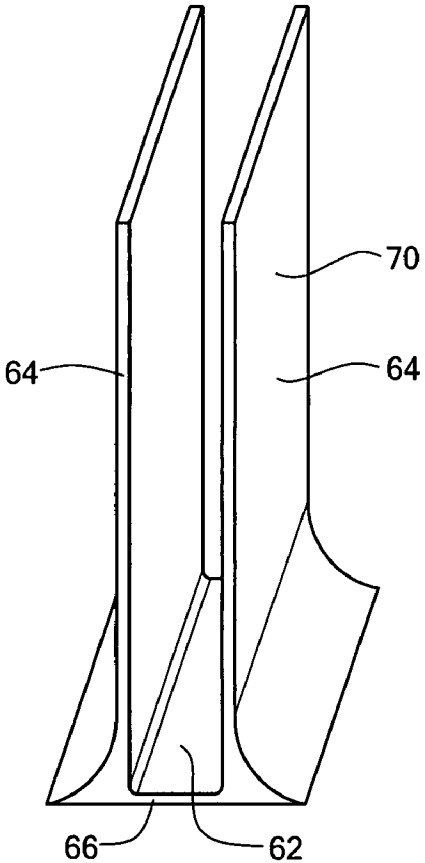
FIG. 6 is a schematic illustration of a further embodiment of a shoe of the present invention suitable for attachment to a composite support surface.

FIG. 6 illustrates a further embodiment of a coaming or shoe suitable for attachment to a deck or other support surface made of a composite material. The shoe includes a panel seat 62 defined by two parallel webs 64 and a bottom plate 66. The bottom plate is fastened to the deck, such as with an adhesive, mechanical fasteners such as screws, or with a combination of adhesive bonding and mechanical fasteners. A panel is then inserted into the seat. The panel is preferably bonded to the shoe with a suitable adhesive within the seat. Additional fastening between the shoe and the panel can be provided by mechanical fasteners such as screws or rivets if desired.

The panel and the shoe are preferably formed as separate parts to simplify installation. The shoe may be attached to the deck first and then the panel bonded to the shoe.

Figure 7:
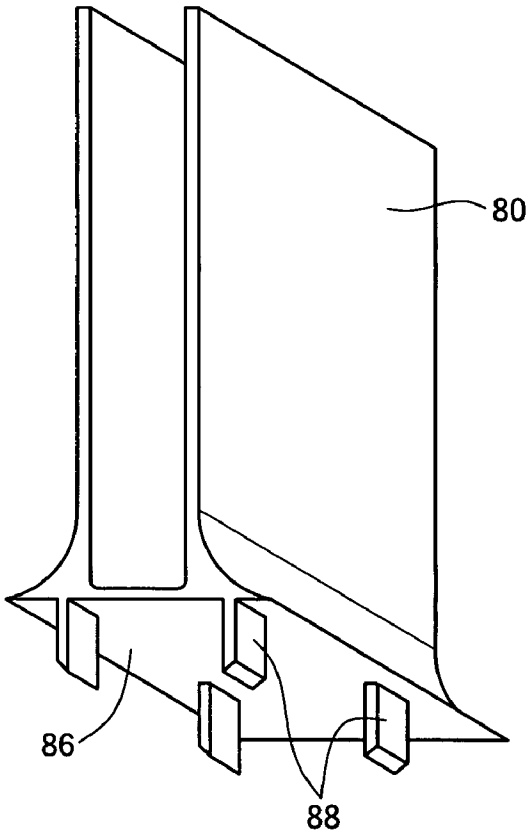
FIG. 7 is a schematic illustration of a further embodiment of a shoe of the present invention suitable for attachment to a composite support surface.

A further embodiment of a shoe 80 illustrated in FIG. 7 includes additional tangs 88 depending from the bottom plate 86 that are inserted in complementary slots formed in the deck (not shown). The tangs increase the bonded surface area between the shoe and the deck to improve transverse and vertical load distribution. The tangs are illustrated orthogonal to the bottom plate, although they could also be angled.

Figure 8:
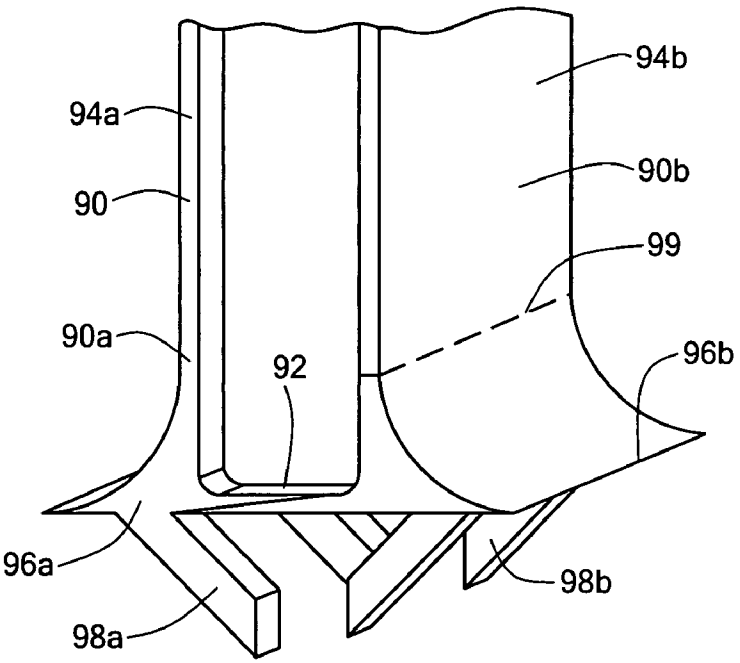
FIG. 8 is a schematic illustration of a further embodiment of a shoe of the present invention suitable for attachment to a composite support surface.

FIG. 8 illustrates an embodiment of a shoe 90 formed in two parts 90*a* and 90*b*. One part includes a web 94*a* and flange 96*a*, with tangs 98*a* for insertion into slots in the deck. The tangs are illustrated at an angle in this embodiment. The other part 90*b* similarly includes a web 94*b* and flange 96*b*, with tangs 98*b*, shown angled, for insertion into slots in the deck. The two flanges 96*a*, 96*b* are tapered and overlap to form the bottom of a seat 92 for the panel. The shoe parts can be formed separately, or one shoe part can be formed integrally with the panel if desired. The shoe can also be formed in three parts, indicated by the dashed line 99, if desired.

Figure 9:
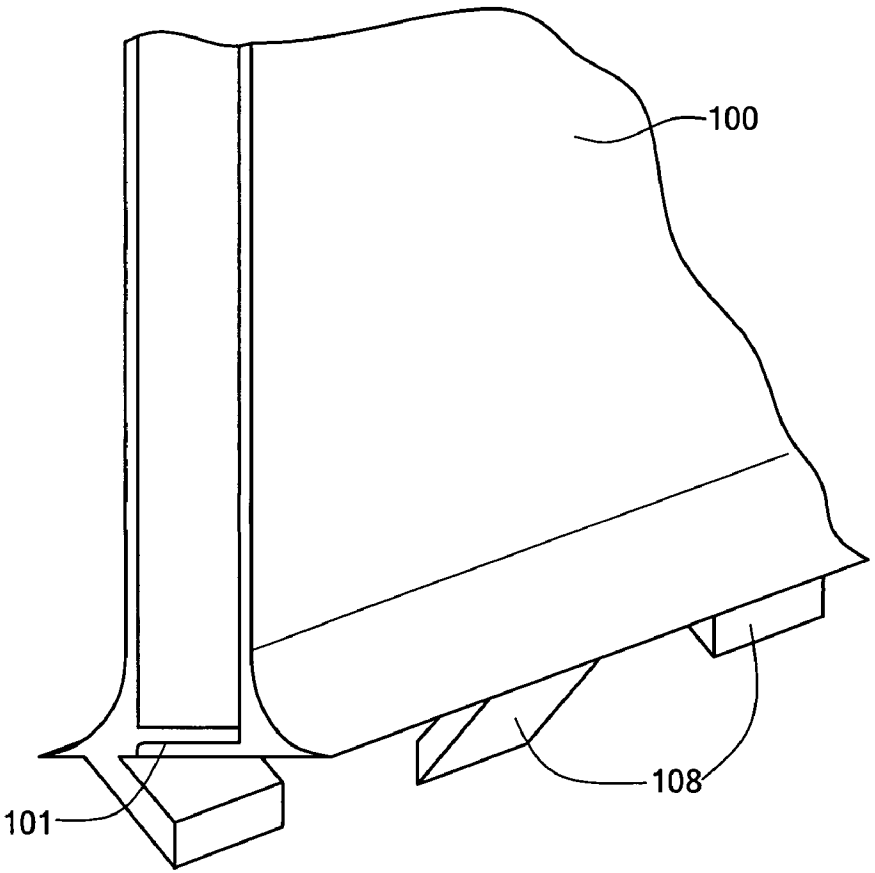
FIG. 9 is a schematic illustration of a further embodiment of a shoe of the present invention suitable for attachment to a composite support surface.
Figure 10:
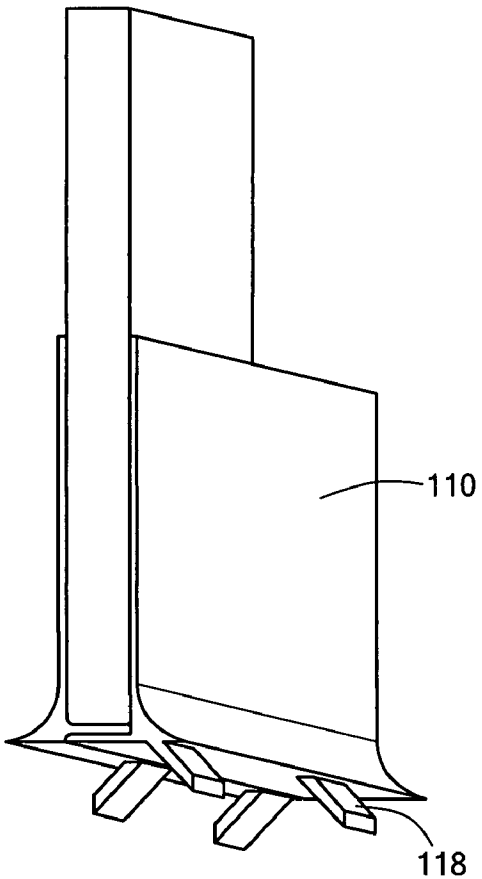
FIG. 10 is a schematic illustration of a further embodiment of a shoe of the present invention suitable for attachment to a composite support surface.

FIG. 9 illustrates a further embodiment of a shoe 100 similar to that of FIG. 8 in which one flange includes a cut out portion 101 to receive the other flange. Also, the tangs 108 are transversely offset from each other along the length of the shoe. In both of these embodiments, the mechanical locking from the tangs is located below the panel and shoe. FIG. 10 illustrates a shoe 110 in which the tangs 118 are directed outwardly, making visual inspection of any composite deck delamination more apparent along the edge of the shoe.

Figure 11:
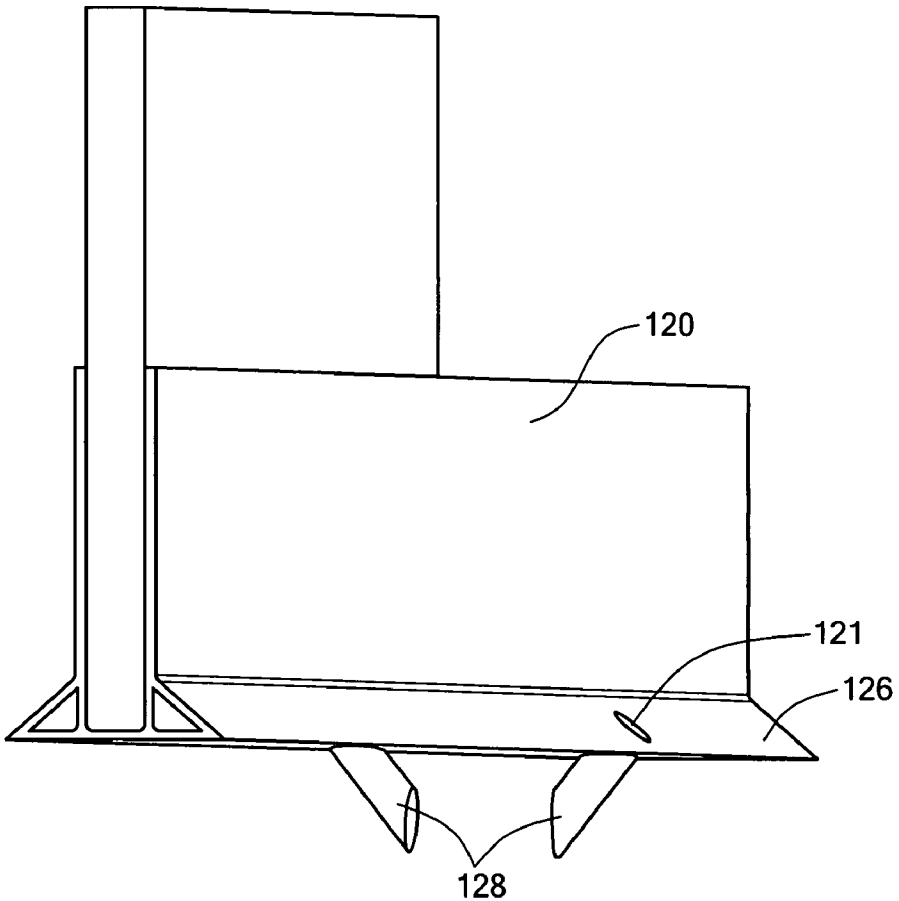
FIG. 11 is a schematic illustration of a further embodiment of a shoe of the present invention suitable for attachment to a composite support surface.

FIG. 11 illustrates a still further embodiment of a shoe 120 in which, after the shoe is bonded to the deck, holes 121 are drilled through the flanges 126 of the shoe and into the deck, and pins 128 are driven through the holes into the deck. The holes may also be filled with an adhesive for additional strength. The pins may be a composite material, formed by any suitable process including pultrusion, or another suitable material, such as metal. The shoe and panel can be formed integrally as a single piece or separately.

Figure 12:
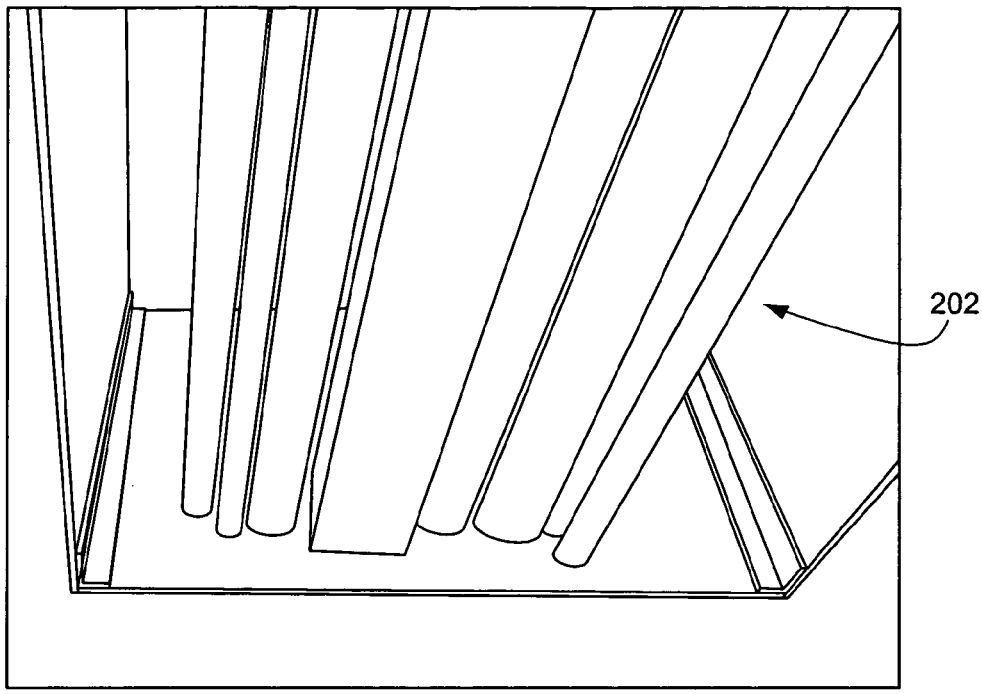
FIG. 12 is a perspective view of an overhead area illustrating a number of pipes.
Figure 13:
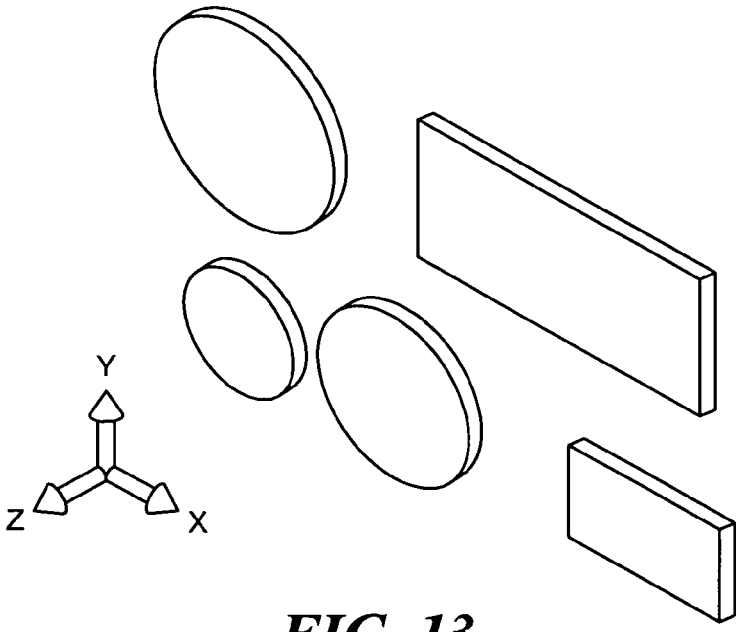
FIG. 13 is an illustration of three-dimensional location data of the scanned objects of FIG. 12.

The present invention also provides a method for fabricating and installing a curtain plate that optimizes the shapes and cuts of the curtain plate to provide sections to fit around overhead piping and other equipment. With this method, the overhead piping and other equipment 202 (see FIG. 12) is scanned with suitable precision laser scanning equipment to produce a three-dimensional scan at each curtain plate location. The laser scanning equipment includes a scanning head that is mounted to a six-axis arm that pinpoints the location of the scanner with respect to the mounting base of the machine. The scanning equipment can be located on a mobile cart to travel readily from one curtain wall location to the next curtain wall location. The scanner information and the arm location are fed into a computer that can then determine the location of the scanned objects in space. See FIG. 13.

Figure 14:
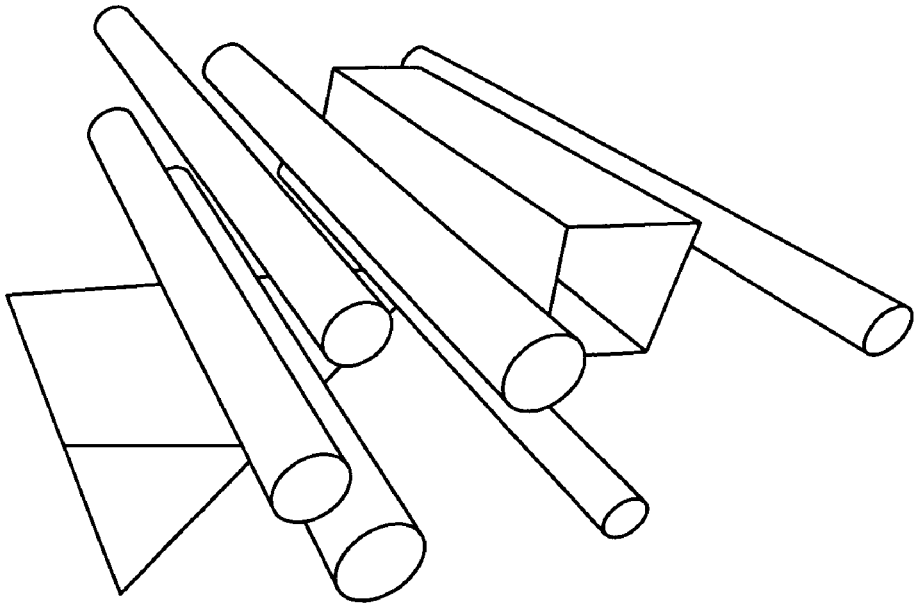
FIG. 14 is an illustration of three-dimensional model of the scanned objects of FIG. 12.

Alternatively, a close range photogrammetry process can be used to generate the three-dimensional data. In this process, digital photographs are taken of the equipment from three angles. The photographs are converted into a three-dimensional solid model or map. See FIG. 14.

Figure 15:
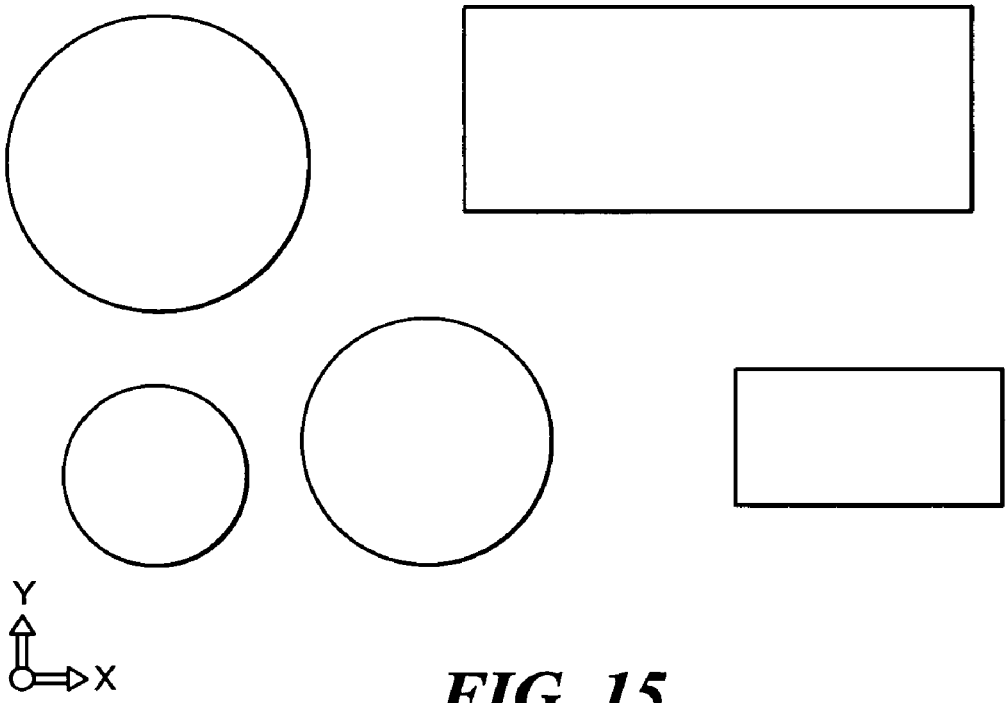
FIG. 15 is a two-dimensional view generated from the three-dimensional data of the objects of FIG. 12.

The point cloud data from the laser scan or the three-dimensional model from the photographs is converted into two-dimensional drawing (FIG. 15) of the equipment for automated machine cutting. This conversion is a routine CAD task, in which an appropriate face for viewing is selected by passing a plane through the three-dimensional data from the scan or model of the overhead equipment.

Each object in the two-dimensional view is then identified by type so that any desired changes or constraints such as offsets or clearances can be applied. For example, a pop-up menu of types of objects is provided to allow user selection of the appropriate type for each object. For each type of object, a set of steps to specify the shape of the cutout needed for that object is provided. In this manner, offsets or clearances can be inserted for insulation or a seal if required.

Figure 16:
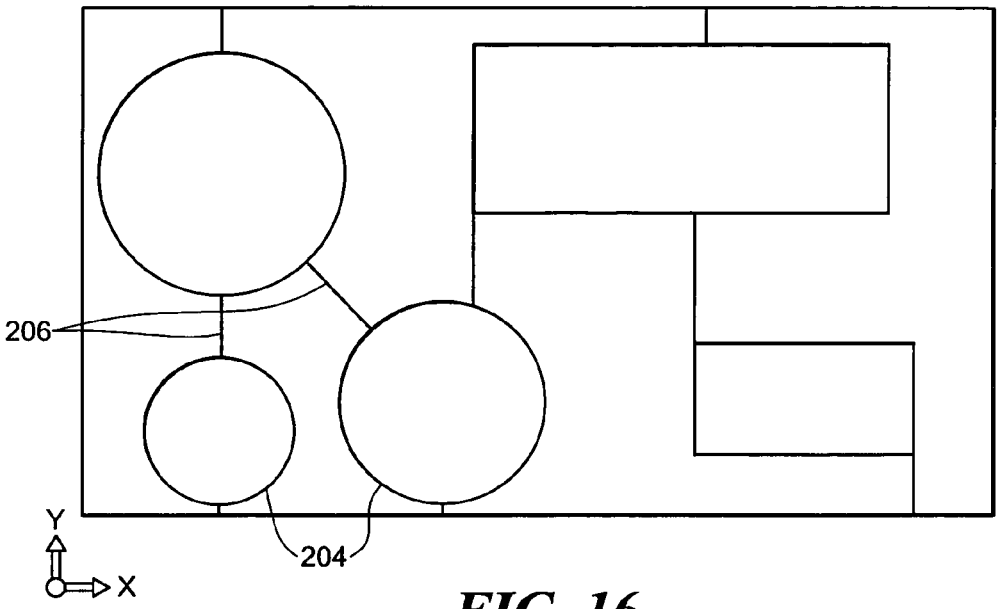
FIG. 16 is a view of the cuts to be made in a panel to form curtain plate sections to fit around the overhead objects.
Figure 17:
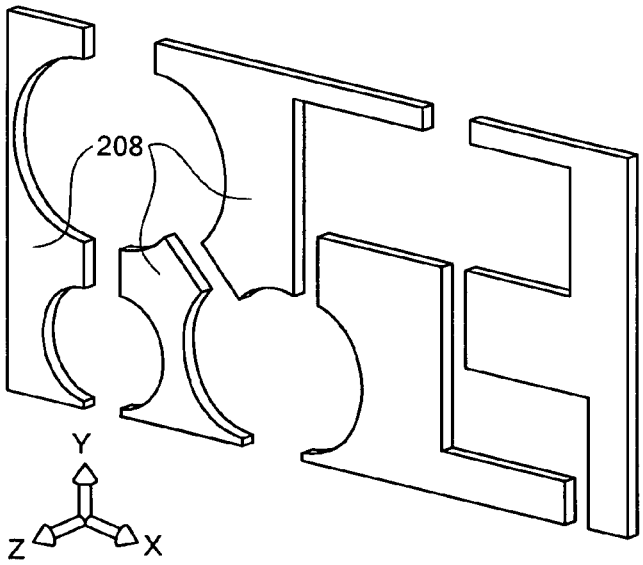
FIG. 17 is an isometric view of a curtain plate cut into a number of sections.

The locations for the cuts 204 for each object and the cuts 206 between the objects are then selected. See FIG. 16. This data is output to drive a numerically controlled cutting machine, which controls the cutting of a suitable panel. FIG. 17 illustrates a curtain plate with the cuts made to form a number of curtain plate sections 208.

The curtain plate sections are installed into the overhead region by fitting them around the overhead piping and attaching them to vertical studs 21 that are attached to and extend downwardly from the ceiling at desired locations. (See FIG. 1.) The joints between the curtain plate sections, between sections and the ceiling, and between the sections and the piping may be taped if desired to close openings against rodents, and provide a visually appealing, light- and air-tight seal.

Figure 18:
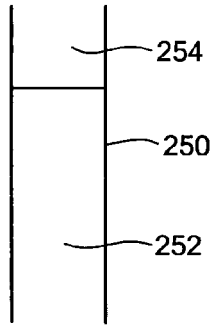
FIG. 18 is a schematic side view of a joint section between a joiner panel and curtain plate.

Joints between the curtain plate and the panel are formed by the joint section 22 between the lower edge of the curtain plate and the upper edge of the panel. In one suitable embodiment, the joint section is an H-section 250 that includes a downwardly-opening channel 252 for receiving the upper edge of the panel and an upwardly-opening channel 254 for receiving the lower edge of the curtain plate. See FIG. 18. The joint section is fastened to either the panel or the curtain plate in any suitable manner, such as fasteners through the upper or lower channel. Preferably, the upper edge of the panel is allowed to move vertically with respect to the lower edge of the curtain plate to accommodate shock loading and simplify installation. For example, the upper edge of the panel can be allowed to move vertically in the downwardly-opening channel 252 of the joint section 250. The joint section can be fabricated from any suitable material and in any suitable process. For example, a composite material part of a fiber-reinforced resin matrix can be produced continuously using pultrusion processing and cut to desired lengths. In alternative embodiments, the joint section can be integrally formed on the upper edge of the panel or the lower edge of the curtain plate, such as by pultrusion. An integrally formed joint detail eliminates the need for a further separate part.

To assemble the entire joiner panel system, the curtain plate sections are first attached to the ceiling, and the joints at the plate sections are taped. A coaming is attached to the floor below the curtain plate, such as by stud welding. Using an H-section curtain plate/panel joint section, the H-section is slid into place on the top edge of a panel. The H-section is then mated to the curtain plate. This joint section allows the panel to be inserted high enough to allow the panel to be set into the channel on the coaming. If desired, fasteners are installed through the coaming and the base of the panel to make a rigid semi-permanent attachment. In this manner, little additional finish is needed. The joints can be taped if desired to provide rodent proofing. An epoxy bead can be applied along the interface between the coaming and the floor if water tightness is required.

In another aspect of the present invention, a panel suitable for the joiner panel system is fabricated from a phenolic resin syntactic foam core covered with face skins on the upper and lower faces. Phenolic resins provide good fire, smoke and toxicity properties. They are, however, more brittle than other resins, and thus, in prior art panels, have inferior mechanical properties. The present invention provides a panel incorporating a phenolic resin matrix material for the panel core having improved mechanical properties, including greater strength and ductility.

The syntactic foam core material is made from a mixture of a phenolic resin foam, hollow micro-balloons, and fibers. Borden Durite SC1008 laminating phenolic resin is a suitable resin to provide good fire performance. Other suitable commercially available phenolic resins include GP 5236 from Georgia-Pacific and Shea Technologies Fireban room temperature cure phenolic resin. The fibers are included in the mixture to add strength to the panel. The fibers are preferably glass, but other suitable materials, such as carbon or nylon, can be used. Powder materials can also be added to improve the mechanical and fire retardant properties. For example, nylon powder is preferably added to increase the toughness or strain to failure of the material. The micro-balloons reduce the density of the material. The micro-balloons are preferably glass, but other suitable materials, such as fly ash, can be used. The foam porosity provides increased surface area to aid in face sheet adhesion. Other additives can be included in the mixture for other purposes. For example, carbon nanotubes can be added to enhance static dissipation.

The phenolic resin is selected for good fire, smoke, and toxicity properties. Phenolic resins typically are available commercially with a catalyst system. The catalyst system can affect the acidity or pH of the resin, which in turn can affect the other components of the core, such as the glass fibers and glass micro-balloons. Thus, a resin with a pH greater than 9.2 has been found to be too high for the glass fibers and micro-balloons. A pH of 8.2 has been found to be satisfactory. It will be appreciated that other phenolic resins may be suitable for other core mixtures that use different additives for the mechanical properties.

The face skins may be formed of any suitable material, such as glass or carbon fibers in a suitable resin material. A fiberglass material wet out with a suitable resin provides good mechanical properties and reduced weight. Preferably, the same resin used for the form core, a phenolic resin, is used to wet out the face skins. Other materials, such as stainless steel, can, however, be used for the face skins, depending on the application. For example, stainless steel may be a preferred choice in areas, such as kitchens, where a sterile environment is important.

One exemplary panel of the present invention uses 63% by weight phenolic resin, 33% by weight glass micro-spheres, 2% by weight glass fibers, and 2% by weight nylon powder. Measured mechanical properties for the exemplary low density core material are as follows:

| Test Method | Measured Mechanical Property | Measured Value |
|---|---|---|
| 4 Point Bending | Bending Modulus | 126.5 ksi |
| | Bending Stress | 576 psi |
| Transverse Tension | Tensile Modulus | 280 ksi |
| | Ultimate Tensile Strength | 960 psi |
| Flatwise Compression | Compression Modulus | 28.2 ksi |
| | Ultimate Compression Stress | 360 psi |
| Short Beam Shear | Short Beam Modulus | 24.1 ksi |
| | Short Beam Shear Stress | 69 psi |
| Core Density | Density | 13.5 pcf |

It will be appreciated that the proportions of the materials used in the panel are determined by the desired application. For example, more fibers can be used if greater strength is required, or fewer fibers can be used if less strength is required.

It will be appreciated that the panels for use in the joiner panel system can be formed in any suitable manner. However, in one aspect of the present invention, the face skins are co-cured with the core to ensure a good bond between the face skins and the core, rather than adhering face skins to precured cores. By curing the core and face skins together, there is no hard or discrete boundary between the core and the face skins. Rather, the resin matrix forms a continuum from the core to the face skins and good bonding results.

In one embodiment, the panel can be press molded. Using this method, a foam mixture is produced from a phenolic resin, micro-balloons, fibers, and powder. Fiberglass or other suitable layers for the lower face skin are placed into the mold. The mixture is evenly distributed over the bottom face skin within the mold. Then fiberglass or other suitable layers for the upper face skin are placed over the foam mixture. The panel is hot pressed until fully cured.

In embodiment of the present invention, the panel can be manufactured in a pultrusion process. The phenolic resin used for the panel has been considered unsuitable for pultrusion in the prior art. In this case, the core constituents are mixed in line and injected or fed in an uncured state between glass fiber skins that are wet out with the same phenolic resin used in the core. The "green" phenolic resin core mixture and fiberglass skins can be shaped or preformed, for example, by a hand lay up, prior to feeding into the pultrusion die. The skin and the core constituents can be injected or fed continuously. The core and skins cure simultaneously in the pultrusion process. Phenolic resins typically begin cross linking at temperatures about 220° F. and reach final cure at about 400° F. The die length and pulling speed through the die can be selected to achieve a sufficient temperature and dwell time to ensure that the resin fully cures. Similarly, the core can be preheated prior to entering the die. A continuous panel exits the pultrusion die and is cut into smaller panels of any desired length.

Figure 20:
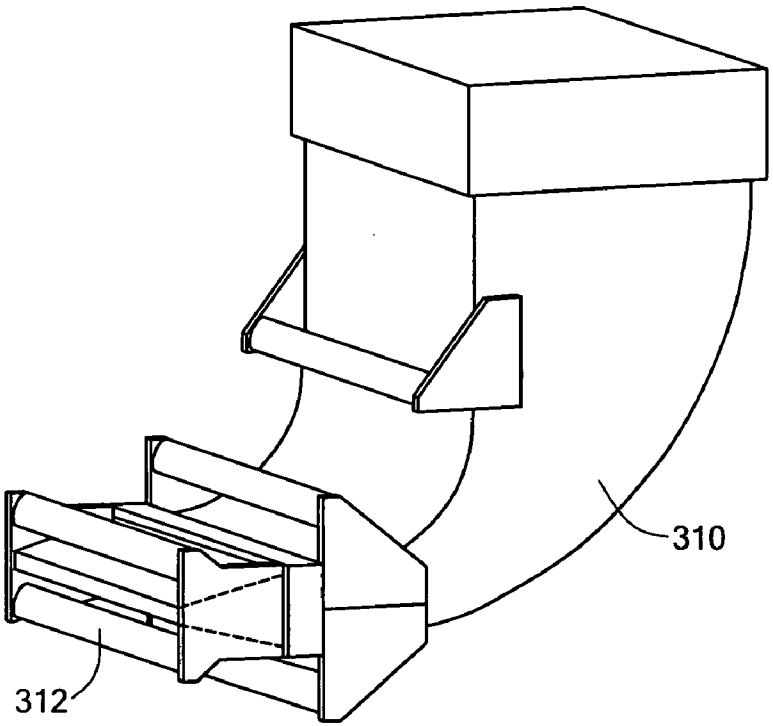
FIG. 20 is a schematic isometric view of a further embodiment of a feed device for manufacturing a panel according to the present invention.
Figure 19:
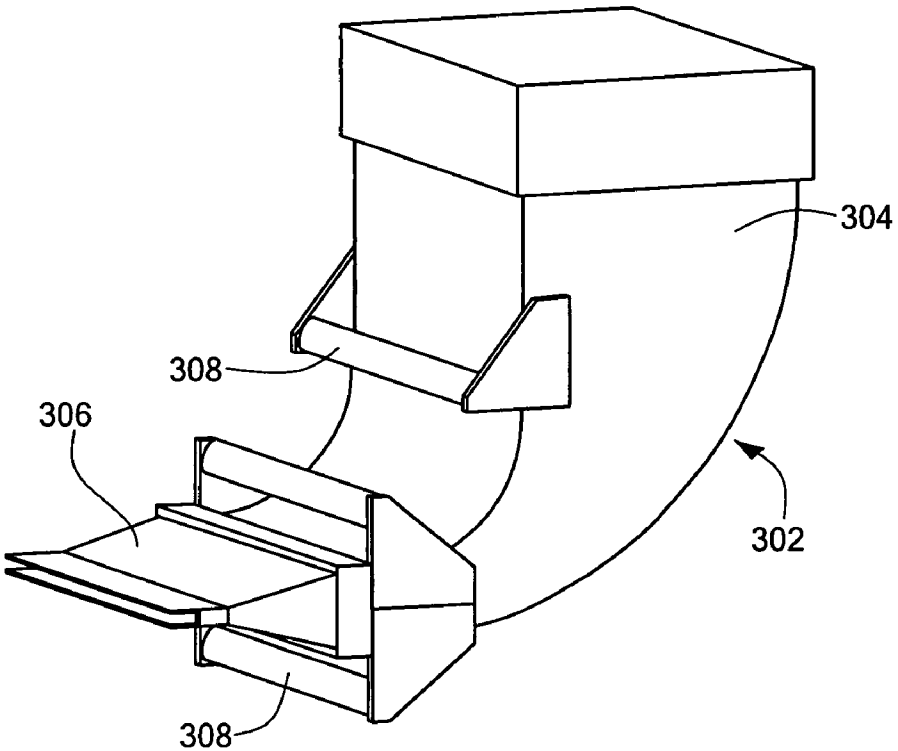
FIG. 19 is a schematic isometric view of a feed device for manufacturing a panel according to the present invention.

In an alternative embodiment, a feed device 302 for inline core curing for the pultrusion process is illustrated in FIG. 19. The feed device includes a hopper 304 for receiving the core mixture and nozzle 306 for directing the mixture into the die. To reduce back flow from pressure build-up between the feed device and the pultrusion die, the nozzle preferably extends into the die (not shown). The nozzle also provides a form for the glass skins to be fed into the die. Guides 308 are provided on the feed device for feeding the face sheets under tension onto upper and lower surfaces of the core mixture as it enters the die. In an alternative feed device 310, illustrated in FIG. 20, guides 312 are provided to direct the face sheets onto the core mixture to aid in containing the core mixture as it enters the die.

It will be appreciated that the panel for a joiner panel system can be produced using other techniques, such as vacuum assisted resin transfer molding. It will also be appreciated that the composite material for the panel can be used in other applications besides the described joiner panel system.

The invention is not to be limited by what has been particularly shown and described, except as indicated by the appended claims.

What is claimed is:

1. A method of producing a composite panel comprising a sandwich structure having a core having opposed surfaces and face skins on the opposed surfaces, comprising:

providing a core mixture comprising a phenolic resin matrix material, hollow micro-spheres, and reinforcing fibers, the hollow micro-spheres and the reinforcing fibers being mixed together in the phenolic resin matrix material to form the core mixture;

forming the core mixture into a planar configuration including opposed surfaces by injecting the core mixture into a pultrusion die;

applying one or more layers of a reinforcing fiber wet out with phenolic resin on the opposed surfaces of the planar configuration and feeding the layers into the pultrusion die with the core mixture; and curing the phenolic resin of the core mixture and the layers on the opposed surfaces simultaneously.

2. The method of claim 1, wherein in the forming step, the core mixture is fed into a hopper and injected through a nozzle into the pultrusion die.

3. The method of claim 2, wherein the layers are fed into the pultrusion die by guides adjacent the nozzle.

4. The method of claim 3, wherein the layers are fed into the pultrusion die under tension.

5. The method of claim 1, wherein in the curing step, the core mixture and the layers are heated and pressed.

* * * * *